US009346261B1

(12) United States Patent
Piatt et al.

(10) Patent No.: US 9,346,261 B1
(45) Date of Patent: May 24, 2016

(54) NEGATIVE AIR DUCT SUMP FOR INK REMOVAL

(71) Applicant: Eastman Kodak Company, Rochester, NY (US)

(72) Inventors: Michael J. Piatt, Dayton, OH (US); David F. Tunmore, Xenia, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 14/835,949

(22) Filed: Aug. 26, 2015

(51) Int. Cl.
*B41J 2/185* (2006.01)
*B41J 2/02* (2006.01)

(52) U.S. Cl.
CPC ..... *B41J 2/02* (2013.01); *B41J 2002/1853* (2013.01)

(58) Field of Classification Search
CPC ..... B41J 2/08; B41J 2/16517; B41J 2/18; B41J 2/1714; B41J 2/1721; B41J 2/185; B41J 2002/1728; B41J 2002/1735; B41J 2002/1742; B41J 2002/1853; B41J 2/02; B41J 2/07
See application file for complete search history.

(56) References Cited

U.S. PATENT DOCUMENTS 4,122,458 A * 10/1978 Paranjpe ..... B41J 2/09 347/77
4,667,207 A * 5/1987 Sutera ..... B41J 2/185 347/90
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
8,091,991 B2 1/2012 Hanchak et al.

* cited by examiner

*Primary Examiner* — Geoffrey Mruk
(74) *Attorney, Agent, or Firm* — Kevin E. Spaulding

(57) ABSTRACT

A gas flow duct for use in redirecting drops of liquid ejected from a printhead in a continuous inkjet printer, including a sump, a first duct portion upstream of the sump, and a second duct portion downstream of the sump. The first duct portion rises from an entrance to an apex and then turns downward and exits into the sump, and the second duct portion rises from the sump toward an exit port. A cross-sectional area of the first duct portion is adapted to produce a gas flow velocity sufficient to transport entrained liquid through the first duct portion past the apex and into the sump. A cross-sectional area of the second duct portion is larger than the cross-sectional area of the first duct portion and is adapted to produce a gas flow velocity insufficient to transport entrained liquid through the second duct portion.

17 Claims, 9 Drawing Sheets

NEGATIVE AIR DUCT SUMP FOR INK REMOVAL

FIELD OF THE INVENTION

This invention pertains to the field of digitally controlled printing devices and more particularly to continuous printing systems in which a liquid stream breaks into droplets that are deflected by a gas flow.

BACKGROUND OF THE INVENTION

Continuous stream inkjet printing uses a pressurized ink source to supply ink to one or more nozzles to produce a continuous stream of ink from each of the nozzles. Stimulation devices, such as heaters positioned around the nozzle, stimulate the streams of ink to break them up into drops with either relatively large volumes or relatively small volumes. These drops are then directed by one of several systems including, for example, electrostatic deflection or gas flow deflection devices.

In printheads that include gas flow deflection systems, the drop deflecting gas flow is typically produced, at least in part, by a gas (e.g., air) being drawn laterally across the drop trajectories into a negative gas flow duct as a result of a vacuum being applied to the duct. Drops of a predetermined small volume are deflected more than drops of a predetermined large volume. This allows for the small drops to be deflected into an ink capturing mechanism (catcher, interceptor, gutter, etc.) where they are either recycled or discarded. The large drops are allowed to strike the print medium. Alternatively, the small drops may be allowed to strike the print medium while the larger drops are collected in the ink capturing mechanism.

It has been determined that while small drops are deflected by the lateral airflow more than large drops, not all small drops follow the same trajectory. Some of these drops can be deflected sufficiently by the air flow such that they enter the gas flow duct, causing ink puddles to form. Ink puddles in the gas flow duct can also be formed during startup and shutdown of the printhead, caused by ink dripping off the upper wall of the gas flow duct and landing on the lower wall of the gas flow duct. Additionally, ink puddles can be formed due to a crooked jet which causes ink to be directed into the gas flow duct. Ink from the puddles of ink in the gas flow duct can be dragged by the gas flow up into the vacuum source that is attached to the gas flow duct, possibly damaging the vacuum source. If the ink puddles remain close to the entrance to the duct, these puddles can affect the uniformity of the air flow across the width of the jet array. Ink puddles can induce oscillations in the gas flow that can produce a modulation in the print drop trajectories that adversely affect print quality.

Commonly assigned U.S. Pat. No. 8,091,991 to Hanchak et al., entitled "Continuous printhead gas flow duct including drain," describes a drain for removing such ink from the negative gas flow duct, and also a method for cleaning the negative gas flow duct. It has been found that under some conditions, typically during the startup and shut down sequences, significant amounts of ink can be ingested into the negative gas flow duct. Under these conditions the ingested ink tends to flow along the walls of the duct, with the flow of air through the duct causing the ingested ink to be drawn into the duct into regions of the duct where it cannot be removed via the duct drain, such as downstream of the duct drain. The ink can then accumulate in these regions where it eventually affects the gas flow through the duct, degrading the operation of the printhead.

Accordingly, a need exists for a means to remove such ink deposits from the interior of the negative gas flow duct, to reduce or even prevent a degradation of the operation of the printhead.

SUMMARY OF THE INVENTION

The present invention represents a gas flow duct for use in redirecting drops of liquid ejected from a printhead in a continuous inkjet printer, includes:

a sump;

a first duct portion upstream of the sump, the first duct portion rising from an entrance to an apex and then turning downward and exiting into the sump, the entrance of the first duct portion being positioned in proximity to the drops of liquid to be redirected;

a second duct portion downstream of the sump, the second duct portion rising from the sump toward an exit port;

wherein a cross-sectional area of the first duct portion is adapted to produce a gas flow velocity sufficient to transport entrained liquid through the first duct portion past the apex and into the sump; and wherein a cross-sectional area of the second duct portion is larger than the cross-sectional area of the first duct portion and is adapted to produce a gas flow velocity insufficient to transport entrained liquid through the second duct portion.

This invention has the advantage that any fluid, such as ink, which is pulled into the gas flow duct is carried through the first duct portion to the sump, where it can be collected and removed.

It has the additional advantage that the fluid is prevented from exiting the gas flow duct through the exit port where it could contaminate downstream components.

Figure 1:
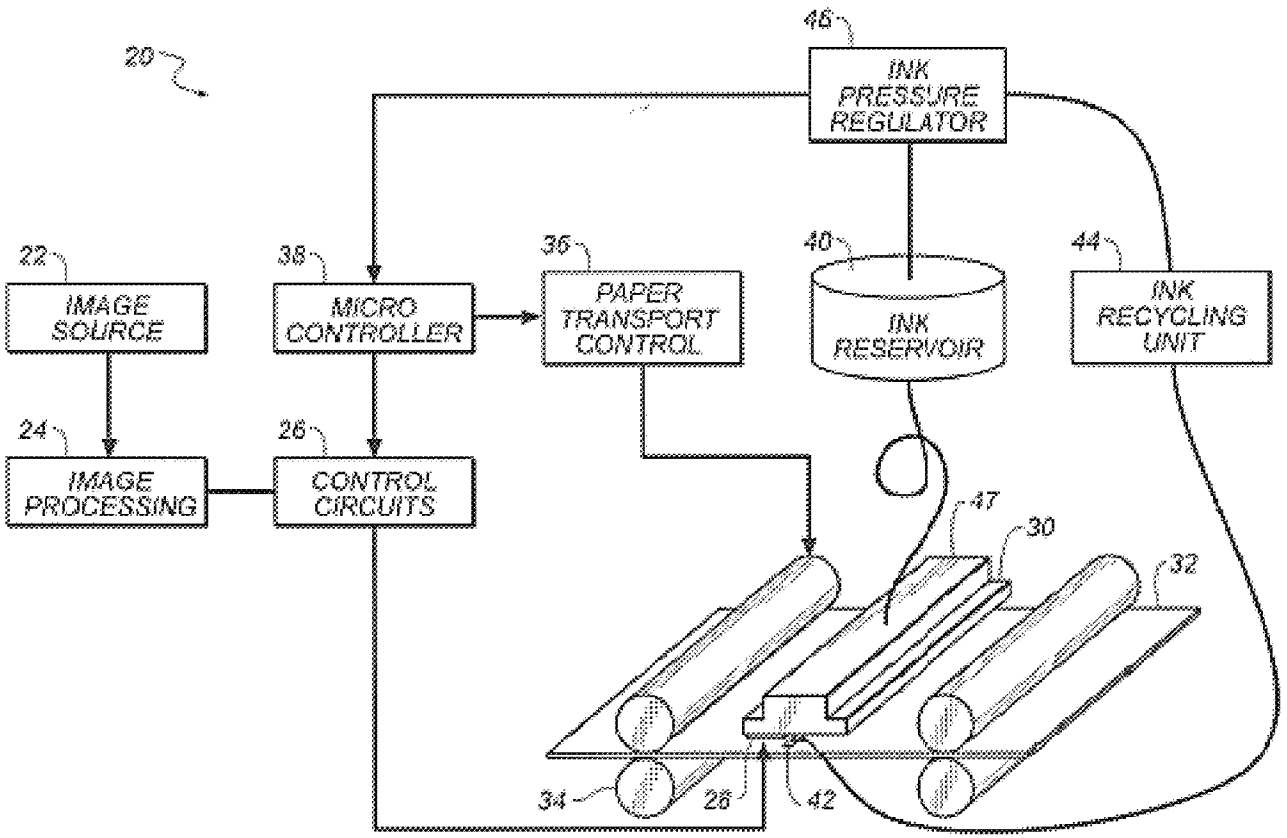
FIG. 1 shows a simplified schematic block diagram of an exemplary printing system.

It is to be understood that the attached drawings are for purposes of illustrating the concepts of the invention and may not be to scale.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

In the following description and drawings, identical reference numerals have been used, where possible, to designate identical elements.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to bitmap image data by an image processing unit 24, which also stores the image data in a memory. A plurality of drop forming mechanism control circuits 26 read data from the image memory and apply time-varying electrical pulses to drop-forming mechanisms 28 that are associated with one or more nozzles of a printhead 30. These pulses are applied at the appropriate time, and to the appropriate nozzles, so that drops formed from a continuous ink jet stream will form spots on a recording medium 32 in the appropriate position designated by the image data in the image memory.

Recording medium 32 is moved relative to printhead 30 by a recording medium transport system 34, which is electronically controlled by a recording medium transport control system 36, and which in turn is controlled by a micro-controller 38. The recording medium transport system 34 shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art.

In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. When the image data does not call for printing a drop on the recording medium, continuous ink jet drop streams are unable to reach recording medium 32 due to an ink catcher 42 that blocks the stream and which may allow a portion of the ink to be recycled by an ink recycling unit 44. The ink recycling unit 44 reconditions the ink and feeds it back to ink reservoir 40. Such ink recycling units 44 are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir 40 can be left unpressurized, or even under a reduced pressure (vacuum), and a pump is employed to deliver ink from the ink reservoir 40 under pressure to the printhead 30. In such embodiments, the ink pressure regulator 46 can comprise an ink pump control system. As shown in FIG. 1, ink catcher 42 is a type of catcher commonly referred to as a "knife edge" catcher. Those skilled in the art will recognize that other types of ink catchers 42 can be used in other embodiments.

The ink is distributed to printhead 30 through an ink channel 47. The ink preferably flows through slots or holes etched through a silicon substrate of printhead 30 to its front surface, where a plurality of nozzles and drop-forming mechanisms 28 (e.g., heaters) are situated. When printhead 30 is fabricated from silicon, control circuits 26 can be integrated with the printhead. Printhead 30 also includes a deflection mechanism (not shown in FIG. 1), which is described in more detail below with reference to FIGS. 2 and 3.

Figure 2:
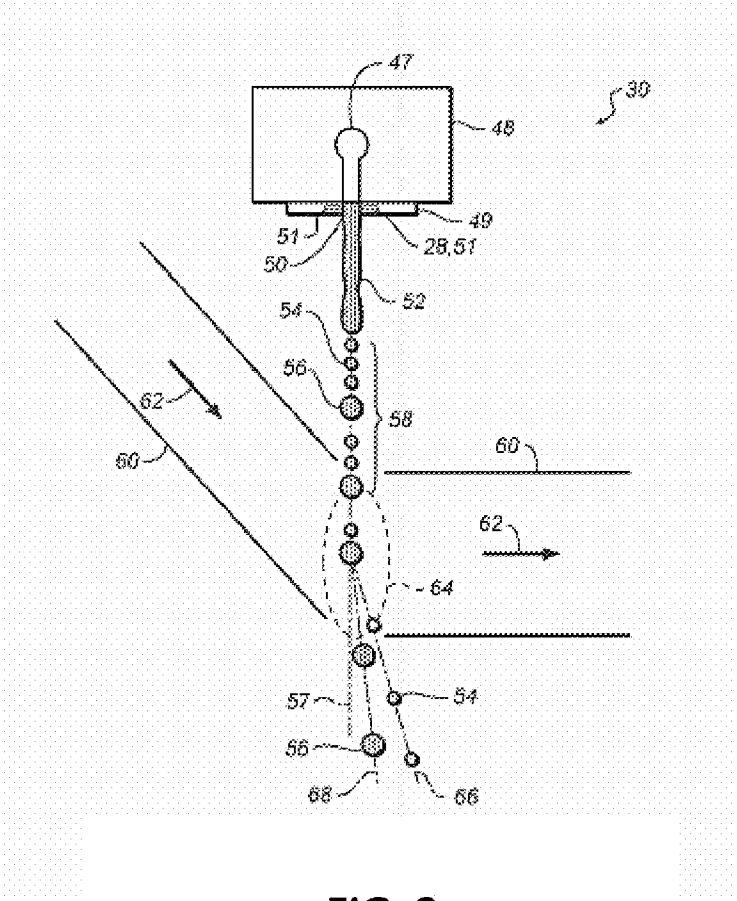
FIG. 2 is a schematic view of an exemplary continuous printhead.
Figure 3:
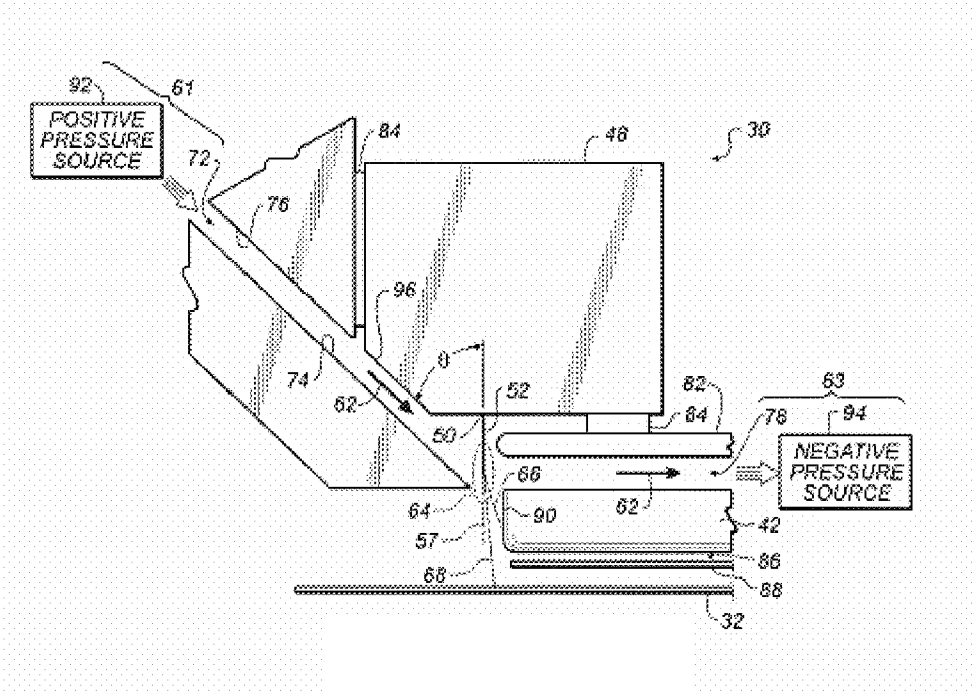
FIG. 3 is a schematic view showing additional features of the exemplary continuous printhead of FIG. 2.

Referring to FIG. 2, a schematic view of an exemplary continuous liquid printhead 30 is shown. A jetting module 48 of printhead 30 includes an array or a plurality of nozzles 50 formed in a nozzle plate 49. In FIGS. 2-5, the array of nozzles 50 extends into and out of the figure. In FIG. 2, the nozzle plate 49 is affixed to the jetting module 48. However, as shown in FIG. 3, nozzle plate 49 can be integrally formed with jetting module 48 in some embodiments.

Liquid (e.g., ink) supplied through ink channel 47 is emitted under pressure through each nozzle 50 of the array to form filaments of liquid 52. Jetting module 48 is operable to form liquid drops having a first size or volume and liquid drops having a second size or volume through each nozzle. To accomplish this, jetting module 48 includes a drop-forming mechanism 28 (i.e., a drop-stimulation mechanism), for example, a heater 51 or a piezoelectric actuator, that, when selectively activated, perturbs each filament of liquid 52, for example, ink, to induce portions of each filament to break off from the filament and coalesce to form drops 54, 56.

In FIG. 2, drop-forming mechanism 28 is a heater 51, for example, an asymmetric heater or a ring heater (either segmented or non-segmented), located in a nozzle plate 49 on one or both sides of nozzle 50. This type of drop formation is known and has been described in, for example, U.S. Pat. No. 6,457,807, to Hawkins et al., entitled "Continuous ink jet printhead having two-dimensional nozzle array and method of redundant printing;" U.S. Pat. No. 6,491,362, to Jeanmaire, entitled "Continuous ink jet printing apparatus with improved drop placement;" U.S. Pat. No. 6,505,921 to Chwalek et al., entitled "Ink jet apparatus having amplified asymmetric heating drop deflection;" U.S. Pat. No. 6,554,410 to Jeanmaire et al., entitled "Printhead having gas flow ink droplet separation and method of diverging ink droplets;" U.S. Pat. No. 6,575,566 to Jeanmaire et al., entitled "Continuous inkjet printhead with selectable printing volumes of ink;" U.S. Pat. No. 6,588,888 to Jeanmaire et al., entitled "Continuous ink jet printing method and apparatus;" U.S. Pat. No. 6,793,328 to Jeanmaire, entitled "Continuous ink jet printing apparatus with improved drop placement;" U.S. Pat. No. 6,827,429 to Jeanmaire et al., entitled "Continuous ink jet printing method and apparatus with ink droplet velocity discrimination;" and U.S. Pat. No. 6,851,796 to Jeanmaire et al., entitled "Continuous ink jet printing apparatus having an improved droplet deflector and catcher."

Typically, one drop-forming mechanism 28 is associated with each nozzle 50 of the nozzle array. However, a drop-forming mechanism 28 can be associated with groups of nozzles 50 or all of nozzles 50 of the nozzle array. The drop-forming mechanism 28 (shown in FIGS. 1 and 2) associated with jetting module 48 is selectively actuated to perturb the filament of liquid 52 to induce portions of the filament to break off from the filament to form drops 54, 56. In this way, drops are selectively created in the form of large drops 56 and small drops 54 that travel toward a recording medium 32.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically between about 2 and 10. A drop stream 58 including drops 54, 56 follows a drop path or trajectory 57.

Printhead 30 also includes a gas flow deflection mechanism 60 that directs a gas flow 62, (e.g., a flow of air) past a portion of the drop trajectory 57. This portion of the drop trajectory is called the deflection zone 64. As the gas flow 62 interacts with the drops 54, 56 in the deflection zone 64, it alters the drop trajectories. As the drop trajectories pass out of the deflection zone 64, they are traveling at an angle, called a deflection angle, relative to the undeflected drop trajectory 57.

Small drops 54 are more affected by the gas flow 62 than are large drops 56 so that the small drop trajectory 66 diverges from the large drop trajectory 68. That is, the deflection angle for small drops 54 is larger than for large drops 56. The gas flow 62 provides sufficient drop deflection and therefore sufficient divergence of the small and large drop trajectories so that ink catcher 42 (shown in FIGS. 1 and 3) can be positioned to intercept one of the small drop trajectory 66 or the large drop trajectory 68 so that drops following the trajectory are collected by ink catcher 42 while drops following the other trajectory bypass the ink catcher 42 and impinge the recording medium 32 (shown in FIGS. 1 and 3).

When ink catcher 42 is positioned to intercept large drop trajectory 68, small drops 54 are deflected sufficiently to avoid contact with the ink catcher 42 and strike the recording medium 32. As the small drops 54 are printed, this is called "small drop print mode." When the ink catcher 42 is positioned to intercept small drop trajectory 66, large drops 56 are the drops that print. This is referred to as "large drop print mode."

Referring to FIG. 3, positive-pressure gas flow structure 61 of gas flow deflection mechanism 60 (FIG. 2) is located on a first side of drop trajectory 57. Positive-pressure gas flow structure 61 includes positive gas flow duct 72 that includes a lower wall 74 and an upper wall 76. Positive gas flow duct 72 directs gas flow 62 supplied from a positive-pressure source 92 at downward angle θ of approximately a 45° relative to the filament of liquid 52 toward drop deflection zone 64 (also shown in FIG. 2). An optional seal 84 provides a gas seal between jetting module 48 and upper wall 76 of positive gas flow duct 72.

Upper wall 76 of positive gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative-pressure gas flow structure 63 of gas flow deflection mechanism 60 (FIG. 2) is located on a second side of drop trajectory 57. Negative-pressure gas flow structure 63 includes a negative gas flow duct 78 located between ink catcher 42 and an upper wall 82 that exhausts gas flow from deflection zone 64. The negative gas flow duct 78 is connected to a negative-pressure source 94 that is used to help remove gas flowing through negative gas flow duct 78. An optional seal 84 provides a gas seal between jetting module 48 and upper wall 82.

As shown in FIG. 3, gas flow deflection mechanism 60 (FIG. 2) includes positive-pressure source 92 and negative-pressure source 94. However, depending on the specific application contemplated, gas flow deflection mechanism 60 can include only one of positive-pressure source 92 and negative-pressure source 94.

Gas supplied by positive gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of ink catcher 42. Small drops 54 contact front face 90 and flow down front face 90 and into a liquid return duct 86 located or formed between catcher 42 and a plate 88. Collected liquid is either recycled and returned to ink reservoir 40 (FIG. 1) for reuse or discarded. Large drops 56 bypass ink catcher 42 and travel on to the recording medium 32. Alternatively, ink catcher 42 can be positioned to intercept large drop trajectory 68. Large drops 56 contact ink catcher 42 and flow into a liquid return duct located or formed in ink catcher 42. Collected liquid is either recycled for reuse or discarded. Small drops 54 bypass ink catcher 42 and travel on to recording medium 32.

As shown in FIG. 3, ink catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, ink catcher 42 can be of any suitable design including, but not limited to, a porous face catcher, a delimited edge catcher, or combinations of any of those described above.

Figure 4:
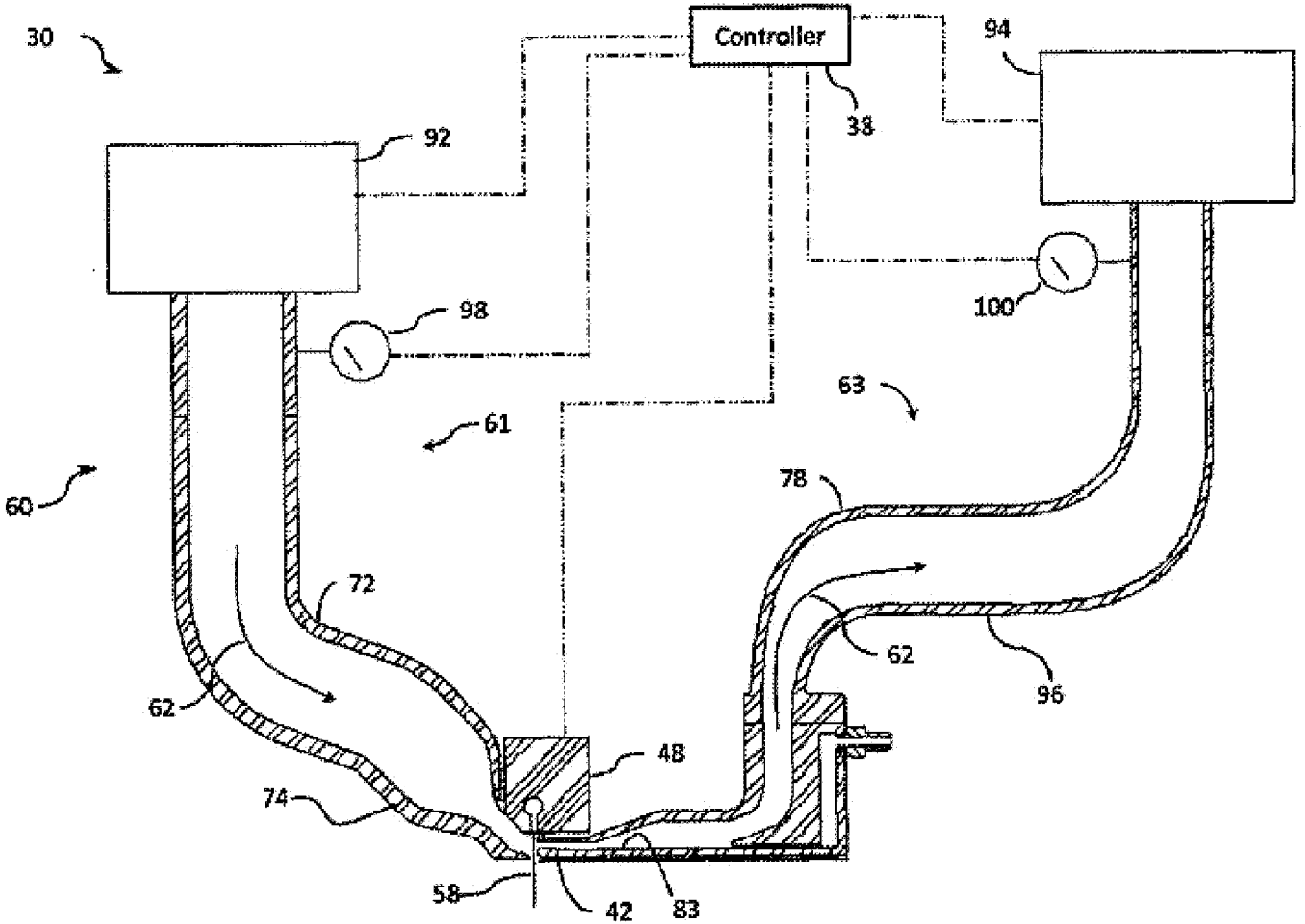
FIG. 4 is a schematic cross-section view of an exemplary continuous inkjet printhead, showing the gas flow ducts.

FIG. 4 provides a broader cross-section view of a printhead 30 than that of FIG. 3 to show more of the gas flow ducts. From the plurality of nozzles of the jetting module 48, drop streams 58 are created. A gas flow deflection mechanism 60 made up of a positive-pressure gas flow structure 61 and a negative-pressure gas flow structure 63 directs a gas flow 62 across the trajectories of the drop streams 58. The positive-pressure gas flow structure 61 includes a positive-pressure source 92 that produces the gas flow 62 through the positive gas flow duct 72, directed toward the trajectories of the drop streams 58. The positive-pressure gas flow structure 61 can also include a first gas flow meter 98 to monitor the flow rate of the supplied gas flow 62. The negative-pressure gas flow structure 63 includes a negative-pressure source 94 that draws the gas flow 62 through the negative gas flow duct 78. A second gas flow meter 100 can be included to monitor the flow rate of the gas through the negative gas flow duct 78. The micro-controller 38 can make use of the output from the first and second gas flow meters 98, 100 as feedback in its control of the positive-pressure source 92 and negative-pressure source 94.

Under some conditions, ink can enter the negative gas flow duct 78. The aforementioned U.S. Pat. No. 8,091,991 provided a drain in the lower wall 83 of the negative gas flow duct 78 through which such ink can be extracted from the negative gas flow duct 78. It has been found however that the airflow through the negative gas flow duct 78 can entrain the some of the ink causing it to flow along the duct wall deeper into the negative gas flow duct 78 than the provided drain. Such ink cannot be extracted by the duct drain of U.S. Pat. No. 8,091,991. This ink can then dry in the negative gas flow duct 78, where a continued buildup of ink can eventually adversely affect the airflow through the negative gas flow duct 78.

Figure 5:
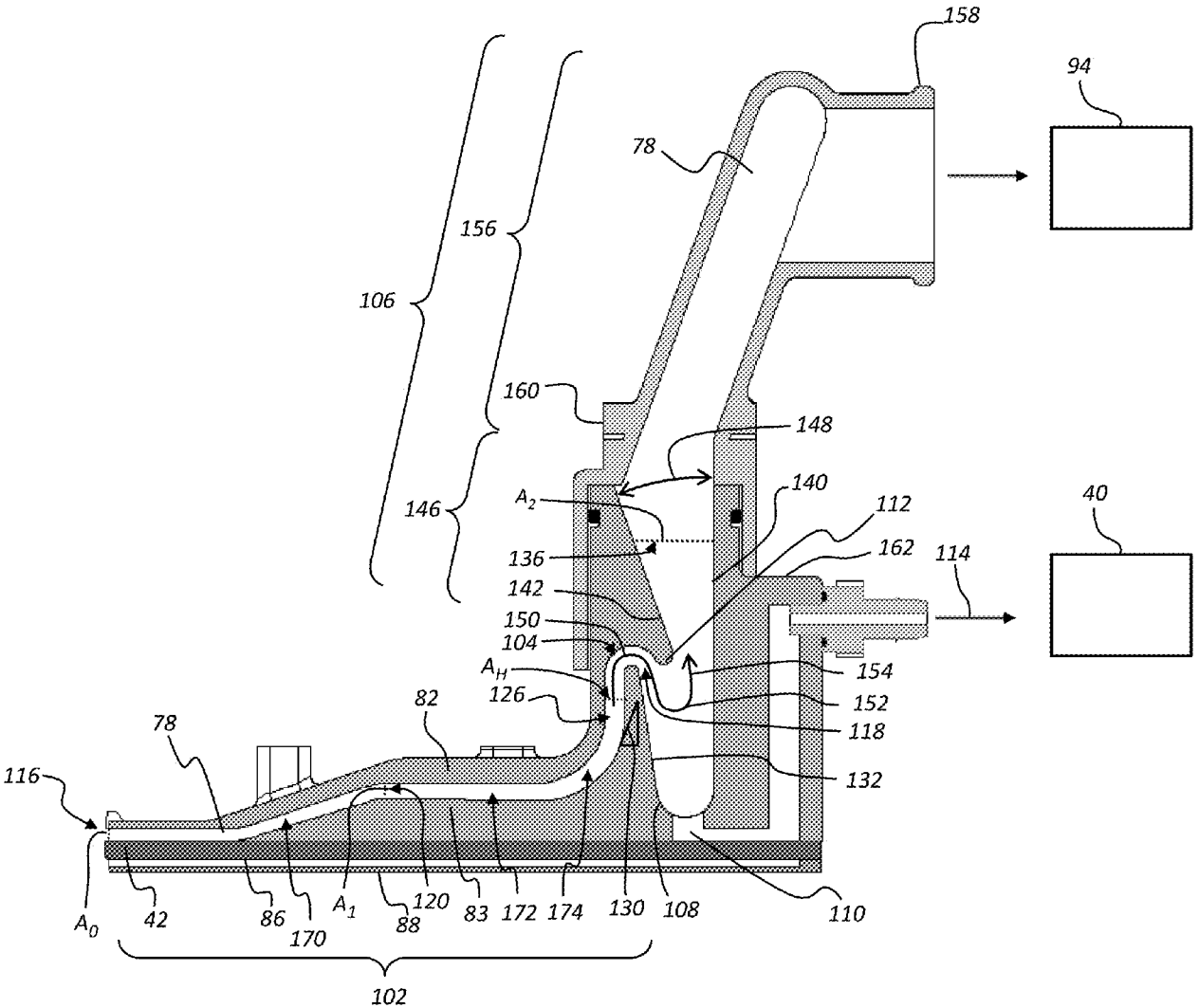
FIG. 5 is a schematic cross-section view of a negative gas flow duct.
Figure 6:
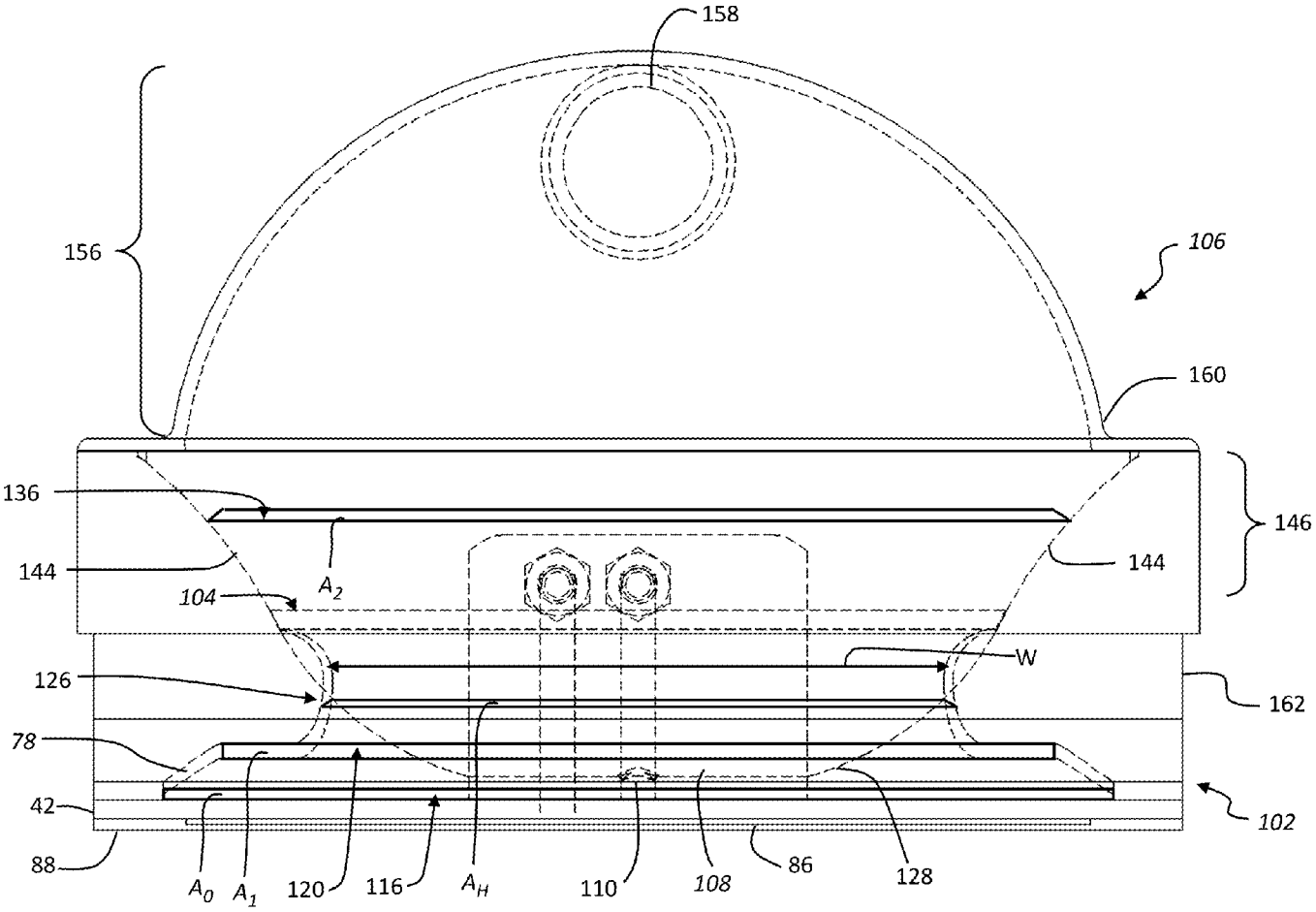
FIG. 6 is a schematic front section view of the negative gas flow duct of FIG. 5.
Figure 7:
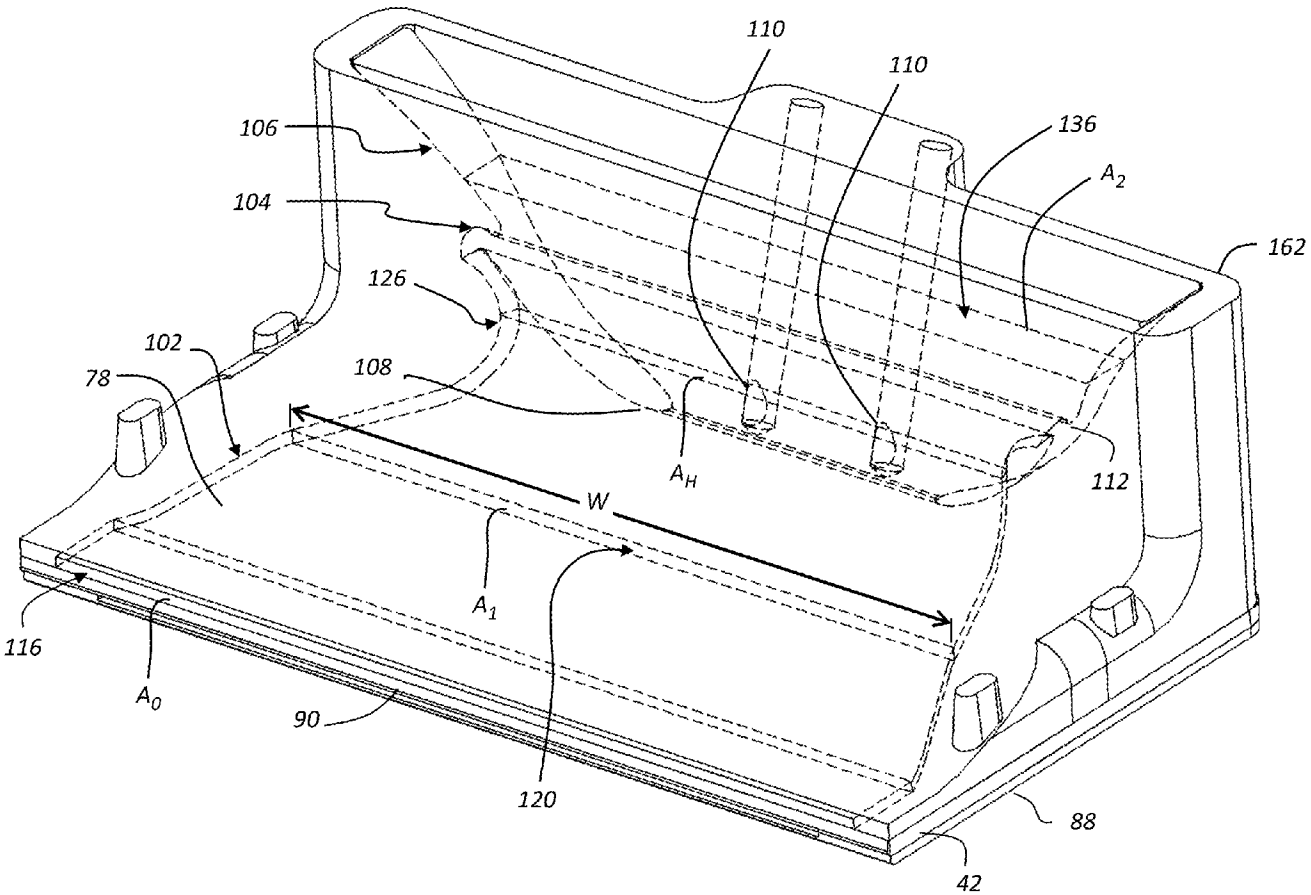
FIG. 7 is a schematic isometric view of the negative gas flow duct of FIG. 5.

To prevent ink from accumulating in the negative gas flow duct 78 where it cannot be extracted, the invention includes a sump 108 for collection of ingested ink as shown in the schematic side view cross-section of FIG. 5. The negative gas flow duct 78 includes a first duct portion 102 between an entrance 116 and the sump 108 and a second duct portion 106 between the sump 108 and the negative-pressure source 94. The first duct portion 102 of the negative gas flow duct 78 rises to an apex 104 (i.e., a peak) and turns downward and exits through exit 118 into the sump 108, where ingested ink is collected. One or more drain(s) 110 at the bottom of the sump 108 allows ink to be extracted from the sump 108. Downstream of the sump 108, the second duct portion 106 of the negative gas flow duct 78 rises again as it continues to the negative-pressure source 94. For further clarity, FIG. 6 shows a schematic front section view of the negative gas flow duct 78, and FIG. 7 shows a schematic isometric view of the negative gas flow duct 78.

To ensure that ingested ink flows all the way to the sump 108, the first duct portion 102 of the negative gas flow duct 78 preferably has a first portion cross-section 120 having a first portion cross-sectional area $A_1$ that is never any larger than an initial cross-sectional area $A_0$ at the entrance 116 of the negative gas flow duct 78 (i.e., $A_1 \leq A_0$). This ensures that the gas flow velocity remains high enough throughout the first duct portion 102 of the negative gas flow duct 78 so that the gas flow can entrain any ink that is attached to a wall of the negative gas flow duct 78, thereby pulling the ink further into the negative gas flow duct 78.

In the illustrated embodiment, the first duct portion 102 of the negative gas flow duct 78 includes a high slope region 126 that is slightly upstream of the apex 104 where the negative gas flow duct 78 is rising with its highest slope 130. Preferably, the first portion cross-section 120 in the high slope region 126 has a high-slope region cross-sectional area $A_H$ that is smaller than for other regions of the first duct portion 102. In particular, the high-slope region cross-sectional area $A_H$ in the high slope region 126 is substantially smaller than the initial cross-sectional area $A_0$. The reduced cross-sectional area in the high slope region 126 produces a higher gas flow velocity in this region so that the gas flow is more effective in dragging the ink up the walls of the duct past the apex 104 of the first duct portion 102. In an exemplary embodiment, the reduced cross-sectional area in the high slope region 126 is produced in part by a reduction in the width W of the first duct portion 102 of the negative gas flow duct 78 (the width W being parallel to the direction of the nozzle array). In a preferred configuration, the high-slope region cross-sectional area $A_H$ in the high slope region 126 is at least 10% smaller than the initial cross-sectional area $A_0$ at the entrance 116, and more preferably is at least 20% smaller.

Following the apex 104, the first duct portion 102 of the negative gas flow duct 78 turns downward toward the exit 118 into the sump 108. A lip 112 at the exit 118 is oriented to direct gas flow downward toward the sump. At this point, the ink that has been dragged along the walls of the first duct portion 102 continues to flow downward toward the sump 108 under the continued action of the gas flow, and now also by gravity. Any ink attached to lower wall 83 of the negative gas flow duct 78 as it passes the apex 104 will continue to flow down wall 132 into the sump 108. Any ink on upper wall 82 of the negative gas flow duct 78 as it passes the apex 104 flows down the upper wall 82 until it reaches lip 112, where the upper wall 82 terminates. The flow of gas along the upper wall 82 blows any ink off the lip 112 down into the sump 108. In some embodiments, the lip 112 includes a sharp terminating corner so that there is a reduced risk of ink flowing around the terminating corner and flowing upward along wall 142 of the second duct portion 106 of the negative gas flow duct 78.

The second duct portion 106 of the negative gas flow duct 78 downstream of and rising from the sump 108 has a second portion cross-section 136 having a second portion cross-sectional area $A_2$. In a preferred embodiment, the second portion cross-sectional area $A_2$ is substantially larger than the first portion cross-sectional area $A_1$ of the first duct portion 102 so that the gas flow velocity in the second duct portion 106 of the negative gas flow duct 78 downstream of the sump 108 is significantly lower than the gas flow velocity in the first duct portion 102 of the negative gas flow duct 78. The cross-sectional areas of the first duct portion 102 and the second duct portion 106 are preferably selected so that the reduced gas flow velocity in the second duct portion 106 of the negative gas flow duct 78 is insufficient to entrain ink up the walls 140, 142, 144 of the second duct portion 106 and carry it out of the sump 108. Preferably, the smallest second portion cross-sectional area $A_2$ of the second duct portion 106 is larger than the largest first portion cross-sectional area $A_1$ of the first duct portion 102 by a factor of at least 2×. In some embodiments, the second duct portion 106 has a non-wetting surface (e.g., a hydrophobic surface) for preventing fluid buildup. Materials and surface treatments that can be used to provide the non-wetting surface are well-known in the art. Examples of such materials would include Teflon, polyethylene, polypropylene and various silicone materials.

To further reduce the gas flow velocity in the second duct portion 106, some embodiments of the invention include an expansion zone 146 in the second duct portion 106 produced by the divergence of walls 140 and 142. Preferably a divergence angle 148 between walls 140 and 142 is less than about 15 degrees so as not to induce turbulence in the expansion zone 146. This is because turbulence in the air flow might result in some localized regions of the second duct portion 106 having upward gas flow velocities sufficient to entrain ink up the walls 140, 142, 144. The side walls 144 of the second duct portion 106 preferably also diverge to further increase the cross-sectional area of the second duct portion 106 of the negative gas flow duct 78.

As shown in FIGS. 5 and 6, above the expansion zone 146 of the second portion, there is a converging zone 156 which funnels the gas flow toward a port 158. In an exemplary arrangement, flexible tube(s) (not shown) connect the port to second gas flow meter 100 (FIG. 4) and negative-pressure source 94. The converging zone 156 and port 158 are typically formed in an upper component 160, which attaches and seals to a lower component 162 that contains the first duct portion 102 of the negative gas flow duct 78 and the sump 108 and expansion zone 146 of the second duct portion 106 of the negative gas flow duct 78. (In FIG. 7, the upper component 160 has been omitted for clarity.)

Ink that enters the sump 108 is removed out of one or more drain(s) 110 at the bottom of the sump 108 and flows through a drain line 114, typically to the ink reservoir 40. The drain(s) 110 can be ported to the bottom of the sump 108 as shown in FIGS. 5 and 6, or can be ported to a side wall of the sump 108 as shown in FIG. 7. A single drain 110 can be used as in FIG. 6, or multiple drains 110 can be used as in FIG. 7. As shown in the front view of FIG. 6, the slope of the side walls 144 of the sump 108 and second duct portion 106 also serves to funnel any collected ink toward reduced cross-section region 128 at the base of the sump 108 where the drain 110 is located to aid in ink removal from the sump 108.

The illustrated configuration of the negative gas flow duct 78 causes the air flow to follow tortuous path 154 having a sharp downward bend 150 at the apex 104 of the first duct portion 102 and then a sharp upward bend 152 at the sump. These sharp bends induce airborne mist to strike walls of the negative gas flow duct 78. The tortuous path 154 thereby reduces the amount of mist that remains airborne downstream of the sump 108.

The slope 130 of the first duct portion 102 of the negative gas flow duct 78 approaching the apex 104 is non-uniform in the illustrated design, with a rising portion 170, a flat portion 172, and a second rising portion 174. Besides providing clearance for the jetting module 48, this configuration provides more changes in direction in the gas flow upstream of the sump 108 to further induce airborne mist to strike a wall of the negative gas flow duct 78. Other geometries are possible in alternate embodiments, including geometries having a uniform slope from near the entrance 116 of the duct all the way to the apex 104.

Preferably the walls of one or both of the first duct portion 102 and the second duct portion 106 intersect at rounded or filleted corners, in particular for those corners that are aligned along the direction of air flow. This reduces the risk of capillary forces holding ink in the corners of the duct, where it might dry or be wicked along the corner deeper into the negative gas flow duct 78.

Figure 8:
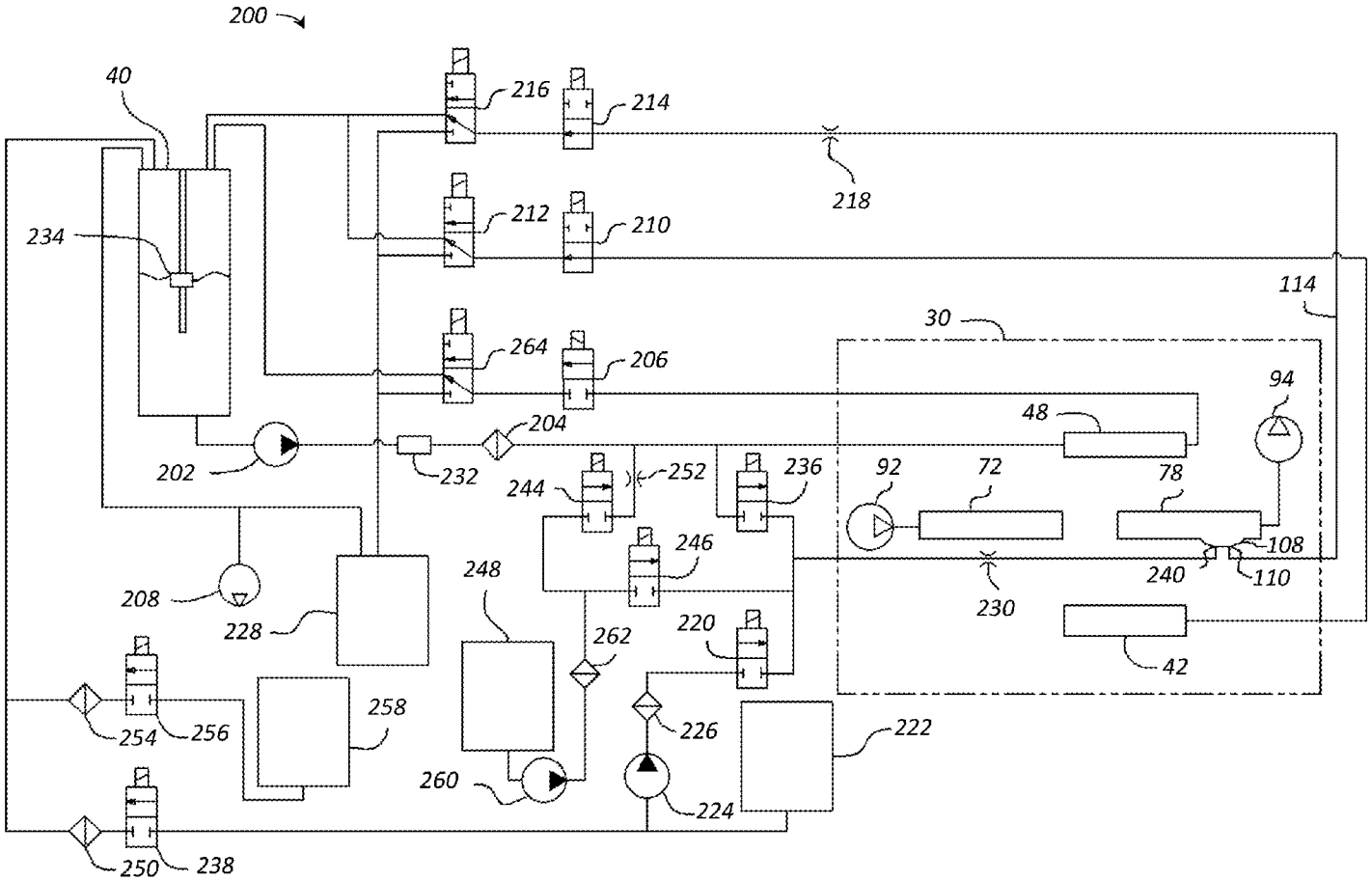
FIG. 8 is a schematic of a fluid system for use with the invention.

FIG. 8 shows an exemplary fluid system 200 that can be employed with this invention to drain fluid from sump 108 of the negative gas flow duct 78, and also for the process of cleaning the sump 108 and the drain line 114. Fluid system 200 includes an ink reservoir 40 from which a printing fluid such as ink is pumped to the jetting module 48 through filter 204 by ink pump 202. To aid in flushing contaminates from the jetting module 48, printing fluid can be cross flushed through the jetting module and returned to the ink reservoir via waste valve 264 when the cross flush valve 206 is open. A vacuum on the ink reservoir 40 provided by vacuum pump 208 aids in returning the printing fluid to the ink reservoir 40. Printing fluid jetted from the jetting module 48 that is collected by catcher 42 is removed from the catcher 42, passing through an open catcher valve 210 to be returned to the ink reservoir 40 via catcher waste valve 212. The vacuum on the ink reservoir 40 aids in the return of this printing fluid as well.

As ink from the ink reservoir 40 is used for printing, the ink level in the ink reservoir 40 drops accordingly. A concentration control system (not shown), upon receiving signals from level sensor 234, can actuate the refill valve 256 to transfer fresh ink from the ink supply 258 through the filter 254 to the ink reservoir to restore the ink level. Evaporation of the ink causes the ink level in the ink reservoir 40 to drop and the ink concentration to rise. The rise in the ink concentration can be detected by a concentration sensor 232, many types of which are well known. The concentration control system, in response to high ink-concentration signals from the concentration sensor 232 or low ink-level signals from the level sensor 234, can actuate replenishment valve 238 to transfer replenishment fluid from replenishment supply 222 through filter 250 to restore the ink level and ink concentration to normal. Typically the replenishment fluid includes only components of the printing fluid such as the carrier solvent, typically water, of the printing fluid, along with other volatile components of the printing fluid, but it does not include the colorants, dyes or pigments, or other non-volatile components of the printing fluid.

The ink drops produced by the jetting module are deflected by the lateral flow of gas across the drop trajectories produced by positive-pressure source 92 directing gas through the positive gas flow duct 72 toward the drop trajectories and by suction into the negative gas flow duct 78 provided by the negative-pressure source 94. Printing fluid entering the negative gas flow duct 78 can be removed from the negative gas flow duct 78 through the drain 110 at the bottom of the sump 108. This printing fluid is removed from the drain 110 via drain line 114 through open valve 214 and is directed to the ink reservoir 40 through return select valve 216 as a result of vacuum on the ink reservoir 40 provided by vacuum pump 208. A flow restrictor 218 may be used in the drain line 114 from the drain 110 to limit the amount of air drawn into the drain 110. Catcher waste valve 212 and return select valve 216 can activated to divert fluid that is normally returned to the ink reservoir 40 from the drain 110 and the catcher 42 into a waste tank 228. This enables highly contaminated printing fluid to be directed to the waste tank 228 rather than contaminating the printing fluid in the ink reservoir 40.

In some embodiments, the drain line 114 is kept open during printhead operation to immediately extract any ink that enters the sump 108. In other embodiments, the sump 108 includes a level sensor (not shown) for detecting the amount of ink in the sump 108. In such embodiments, the drain line 114 may be opened and closed by means of a valve 214 in the drain line 114 in response to the amount of ink in the sump 108. This allows the drain 110 to be closed to reduce the flow of air through the drain line 114 and into the ink reservoir 40.

To keep the printing fluid from drying in the sump 108 or the drain line 114, liquid supply valve 236 is opened to allow pressurized printing fluid from the ink pump 202 to flow through the supply port 240 (FIG. 7) into the sump 108 of the negative gas flow duct 78. A flow restrictor 230 may be used to limit the flow rate of printing fluid to the supply port 240. Preferably, the flow restrictor 230 is located downstream of the liquid supply valve 220, as it has been found that if the flow restrictor 230 is positioned upstream of the liquid supply valve 220, transient pressure surges can occur when liquid supply valve 220 is opened that causes a burst of ink to flow into the sump 108 of the negative gas flow duct 78. The printing fluid that flows into the sump 108 through supply port 240 is extracted through the drain 110. This flow of printing fluid into the sump 108 and out through the drain 110 prevents ink from drying on the lower walls of the sump 108 and from drying in the drain 110 or the drain line 114. Ink can be made to flow into the sump and out the drain continuously while printing on periodic or intermittent basis.

Liquids distinct from the printing fluid can alternatively be used to prevent ink from drying in the sump 108 or the drain line 114. In a preferred embodiment, an alternate liquid comprises the replenishment fluid used by the fluid system to make up for evaporation of the carrier liquid from the printing fluid. Replenishment fluid from the replenishment supply 222 is pumped by pump 224 through filter 226, liquid supply valve 220, and flow restrictor 230 to the supply port 240. The flow of liquid extracted from the drain 110 is controlled by valve 214 and return select valve 216. As a continuous flow of replenishment fluid into the sump 108 and out through the drain 110 and on to the ink reservoir 40 could cause the concentration of the printing fluid in the ink reservoir 40 to drop, the micro-controller 38 (FIG. 1) can control pump 224 and liquid supply valve 220 to intermittently supply the replenishment fluid through the supply port 240 to the sump 108. Alternatively the micro-controller 38 can control whether to direct printing fluid or replenishment fluid to the supply port 240 based on the ink level in the ink reservoir 40 measured by level sensor 234 and on the printing fluid concentration measured by concentration sensor 232. Typically the liquid flow is primarily of printing fluid, supplied by ink pump 202 that passes through liquid supply valve 236 and flow restrictor 230 to the supply port 240. The micro-controller 38 can, based on the output of the level sensor 234 and the concentration sensor 232, close liquid supply valve 236, energize the pump 224 and open liquid supply valve 220 to cause replenishment fluid to be delivered to the supply port 240. This delivered replenishment fluid passes through the sump 108, the drain 110, and valve 214 and return select valve 216 to the ink reservoir 40 to help restore the printing fluid concentration to the desired value. When either the desired amount of replenishment fluid has been directed to the ink reservoir 40 via the sump 108, or the printing fluid concentration has been restored to the desired level, then the micro-controller 38 closes the liquid supply valve 220, de-energizes the pump 224 and opens liquid supply valve 236 to again cause printing fluid to flow through the liquid supply channels.

When the printhead is being shut down or during special cleaning steps, the micro-controller 38 can instead activate pump 260 and cleaning fluid valve 246 to supply a cleaning fluid from cleaning fluid supply 248 to the supply port 240 through filter 262 to more effectively clean printing fluid residue from the negative gas flow duct 78 and the sump 108. The cleaning fluid is extracted through drain 110 and is typically directed through valve 214 and return select valve 216 to the waste tank 228 to prevent the cleaning fluid from contaminating the printing fluid in the ink reservoir 40. During such shut down or special cleaning steps, cleaning fluid valve 244 can also be activated to provide a flow of cleaning fluid through the jetting module 48 to clean the jetting module 48. A flow restrictor 252 may be used to limit the flow rate of cleaning fluid to the jetting module 48. This flow of cleaning fluid through the jetting module 48 is typically directed through cross flush valve 206 and waste valve 264 to the waste tank 228. Some of the cleaning fluid supplied to the jetting module 48 can be made to flow out through the nozzles to clean off portions of the gas flow ducts 72, 78 and the ink catcher 42. By activating the negative-pressure source 94, cleaning fluid that enters the negative gas flow duct 78 can be drawn through the negative gas flow duct 78 to the sump 108, from which it can be removed from the negative gas flow duct 78. In this way, the first duct portion 102 (FIG. 5) of the negative gas flow duct 78 can be cleaned using the cleaning fluid. Cleaning fluid can be pumped into the sump 108 to at least partially fill the sump 108 to enable the walls of the sump 108 to be rinsed off by the cleaning fluid. With the sump 108 filled with cleaning fluid, cleaning fluid can be agitated to enhance cleaning by activating the negative-pressure source 94 to draw air into the sump 108 through the first duct portion 102 of the negative gas flow duct 78. Alternatively the cleaning fluid in the sump 108 can be agitated by supplying pressurized air to supply port 240 by an air source (not shown). By means of such agitation, the cleaning fluid can also be made to clean portions of the walls of the second duct portion 106 of the negative gas flow duct 78. The cleaning fluid is distinct from the printing fluid, and typically can include one or more solvents or cleaning agents which are not included in the printing fluid or replenishment fluid to dissolve and remove dried printing fluid residues. The cleaning fluid typically excludes the colorants or other non-volatile components of the printing fluid.

In some embodiments, a fluid is supplied to the ink channels 47 (FIG. 2) the entire time that printing fluid is jetted from the printhead nozzles 50 (FIG. 2) and there is a flow of gas through the negative gas flow duct 78. In other embodiments, fluid is intermittently supplied to the ink channels 47. In some embodiments the flow of replenishment fluid is controlled by controlling the activation level of pump 224 or pump 260 without the need for liquid supply valve 220 or cleaning fluid valve 244, respectively.

Figure 9:
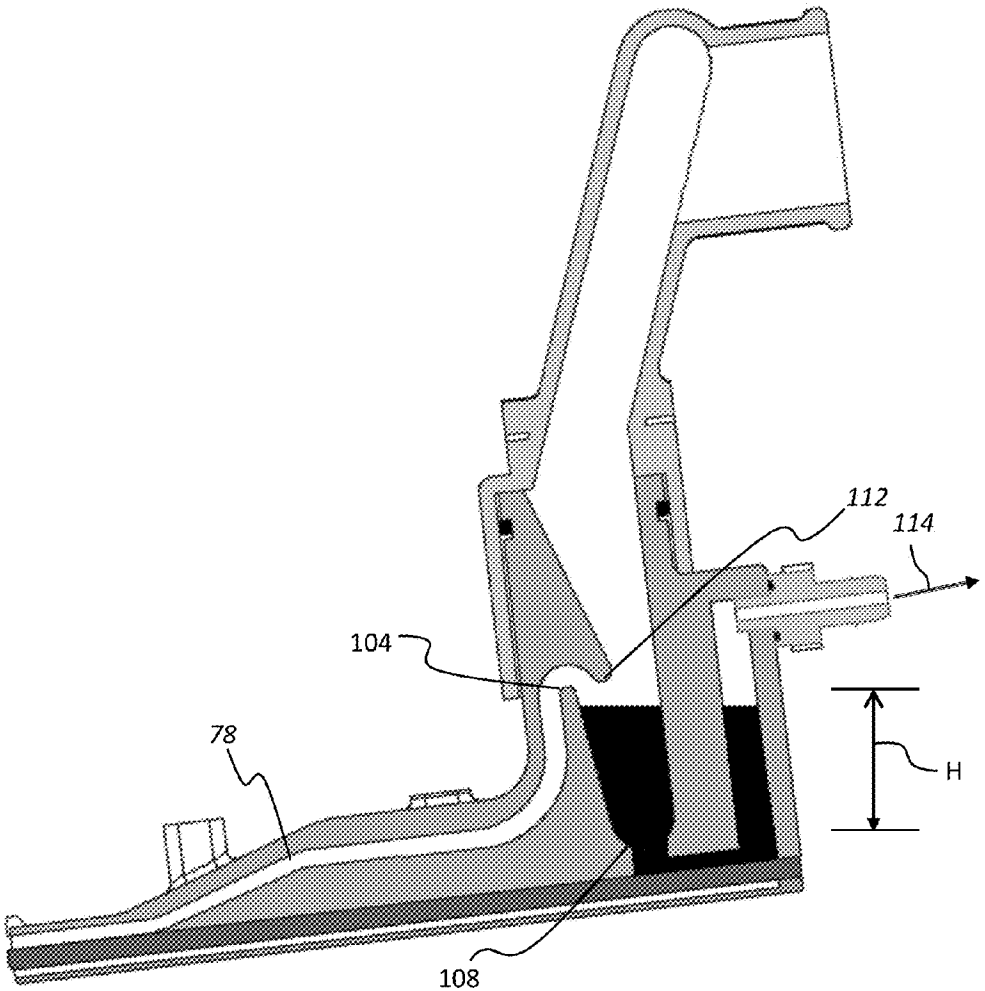
FIG. 9 is a schematic cross-section view showing the negative gas flow duct of FIG. 5 rotated for operation on a sloped portion of a media path.

In many printing systems, it is desirable for the print media to follow an arced media path. In such printing systems, it is desirable to tilt the printhead slightly to correspond to the portion of the arc along which the printhead is positioned, as indicated in FIG. 9. For such printheads, it is desirable for a rise H of the apex 104 relative to the sump 108 to be sufficient that ink will not drain out of the sump over the apex 104 when the air flow through the negative gas flow duct 78 is turned off and the vacuum of the drain line 114 out of the sump 108 is turned off. Furthermore, terminating the lip 112 at approximately the height of the apex 104 reduces the risk of ink being siphoned over the apex and out the entrance of the negative gas flow duct 78.

The invention has been described in detail with particular reference to certain preferred embodiments thereof, but it will be understood that variations and modifications can be effected within the spirit and scope of the invention.

PARTS LIST

20 continuous printer system
22 image source
24 image processing unit
26 control circuits
28 drop-forming mechanism
30 printhead
32 recording medium
34 recording medium transport system
36 recording medium transport control system
38 micro-controller
40 ink reservoir
42 ink catcher
44 ink recycling unit
46 ink pressure regulator
47 ink channel
48 jetting module
49 nozzle plate
50 nozzle
51 heater
52 liquid
54 drops
56 drops
57 trajectory
58 drop stream
60 gas flow deflection mechanism
61 positive-pressure gas flow structure
62 gas flow
63 negative-pressure gas flow structure
64 deflection zone
66 small drop trajectory
68 large drop trajectory
72 positive gas flow duct
74 lower wall
76 upper wall
78 negative gas flow duct
82 upper wall
83 lower wall
84 seal
86 liquid return duct
88 plate
90 front face

92 positive-pressure source
94 negative-pressure source
96 wall
98 gas flow meter
100 gas flow meter
102 first duct portion
104 apex
106 second duct portion
108 sump
110 drain
112 lip
114 drain line
116 entrance
118 exit
120 first portion cross-section
126 high slope region
128 reduced cross-section region
130 slope
132 wall
136 second portion cross-section
140 wall
142 wall
144 wall
146 expansion zone
148 divergence angle
150 downward bend
152 upward bend
154 tortuous path
156 converging zone
158 port
160 upper component
162 lower component
170 rising portion
172 flat portion
174 rising portion
200 fluid system
202 ink pump
204 filter
206 cross flush valve
208 vacuum pump
210 catcher valve
212 catcher waste valve
214 valve
216 return select valve
218 flow restrictor
220 liquid supply valve
222 replenishment supply
224 pump
226 filter
228 waste tank
230 flow restrictor
232 concentration sensor
234 level sensor
236 liquid supply valve
238 replenishment valve
240 supply port
244 cleaning fluid valve
246 cleaning fluid valve
248 cleaning fluid supply
250 filter
252 flow restrictor
254 filter
256 refill valve
258 ink supply
260 pump
262 filter
264 waste valve $A_0$ initial cross-sectional area
$A_1$ first portion cross-sectional area
$A_2$ second portion cross-sectional area
$A_H$ high-slope region cross-sectional area
H rise
W width

The invention claimed is:

1. A gas flow duct for use in redirecting drops of liquid ejected from a printhead in a continuous inkjet printer, comprising:

a sump;

a first duct portion upstream of the sump, the first duct portion rising from an entrance to an apex and then turning downward and exiting into the sump, the entrance of the first duct portion being positioned in proximity to the drops of liquid to be redirected;

a second duct portion downstream of the sump, the second duct portion rising from the sump to an exit port;

wherein a cross-sectional area of the first duct portion is adapted to produce a gas flow velocity through the first duct portion that is sufficient to transport entrained liquid through the first duct portion past the apex and into the sump; and wherein a cross-sectional area of the second duct portion is larger than the cross-sectional area of the first duct portion and is adapted to produce a gas flow velocity through the second duct portion that is insufficient to transport entrained liquid through the second duct portion.

2. The gas flow duct of claim 1, wherein the smallest cross-sectional area of the second duct portion is larger than the largest cross-sectional area of the first duct portion by a factor of at least 2×.

3. The gas flow duct of claim 1, wherein a cross-sectional area of the first duct portion along its length is less than or equal to the cross-sectional area of the first duct portion at the entrance.

4. The gas flow duct of claim 1, wherein the first duct portion includes a high slope region upstream of the apex having a higher slope than other regions of the first duct portion, and wherein the first duct portion has a smaller cross-sectional area in the high slope region than in other regions of the first duct portion.

5. The gas flow duct of claim 4, wherein a cross-sectional area of the first duct portion in the high slope region is at least 20% smaller than a cross-sectional area of the first duct portion at the entrance.

6. The gas flow duct of claim 1, wherein the first duct portion includes an upper wall that terminates in a lip, and wherein the lip is oriented to direct gas flow downward toward the sump.

7. The gas flow duct of claim 1, wherein the second duct portion includes an expansion zone in which a cross-sectional area of the second duct portion increases with increasing distance from the sump.

8. The gas flow duct of claim 7, wherein walls of the second duct portion in the expansion zone diverge with a divergent angle of 15 degrees or less.

9. The gas flow duct of claim 7, wherein the second duct portion includes a converging zone downstream of the expansion zone in which a cross-sectional area of the second duct portion decreases with increasing distance from the sump.

10. The gas flow duct of claim 1, wherein at least a portion of some of the redirected drops of liquid are drawn into the entrance of the gas flow duct and are transported through the first duct portion and into the sump.

11. The gas flow duct of claim 1, wherein the second duct portion includes a non-wetting surface for preventing fluid buildup.

12. The gas flow duct of claim 1, further including a drain located in proximity to a lowest point of the sump for draining liquid from the sump.

13. The gas flow duct of claim 12, further comprising a liquid supply port for supplying a liquid to either the drain or the sump to prevent drying of liquid in the drain line.

14. The gas flow duct of claim 1, wherein walls of one or both of the first duct portion and the second duct portion intersect at rounded or filleted corners.

15. The gas flow duct of claim 1, further including a gas flow source for causing gas to flow through the gas flow duct.

16. The gas flow duct of claim 15, wherein the gas flow source is a negative-pressure gas flow source located downstream of the second duct portion.

17. The gas flow duct of claim 15, wherein the gas flow source is a positive-pressure gas flow source that directs a flow of gas into the entrance of the first duct portion.

* * * * *